US005125758A

United States Patent [19]

DeWan

[11] Patent Number: 5,125,758

[45] Date of Patent: Jun. 30, 1992

[54] PIERCING CLAMP

[76] Inventor: Thomas E. DeWan, 5945 Carrier St. N., St. Petersburg, Fla. 33714

[21] Appl. No.: 622,848

[22] Filed: Dec. 6, 1990

[51] Int. Cl.[5] ..... B42F 13/00

[52] U.S. Cl. ..... 402/25; 24/67 P; 24/67.5; 24/67.7

[58] Field of Search ..... 402/25; 24/67 R, 67 P, 24/67.5, 67.7, 67.11, 355, 351, 707.7

[56] References Cited

U.S. PATENT DOCUMENTS

| | | | |
|---|---|---|---|
| 71,635 | 12/1867 | Parsons | 24/67.7 X |
| 145,809 | 12/1873 | McGill | 402/25 |
| 221,339 | 11/1879 | Moore | 24/67.7 X |
| D. 288,901 | 3/1987 | Zamek . | |
| 327,553 | 10/1885 | Heysinger | 24/67.7 X |
| 457,783 | 8/1891 | Kohnle . | |
| 587,812 | 8/1897 | Grant | 402/25 X |
| 739,436 | 9/1903 | Mumm et al. | 402/25 X |
| 805,393 | 11/1905 | Washburn | 402/25 |
| 958,801 | 5/1910 | Gibbs | 402/25 |
| 1,054,498 | 2/1913 | Bleakney . | |
| 1,329,661 | 2/1920 | Hansen | 402/25 |
| 1,687,581 | 10/1928 | Murphy | 24/707.7 X |
| 1,976,747 | 10/1934 | Reuter et al. . | |
| 2,097,018 | 10/1937 | Chamberlin . | |
| 3,246,376 | 4/1966 | Vazquez | 24/707.7 X |
| 4,241,477 | 12/1980 | Freedom et al. . | |
| 4,525,899 | 7/1985 | Carroll . | |
| 4,628,572 | 12/1986 | Chang . | |

FOREIGN PATENT DOCUMENTS

| | | | |
|---|---|---|---|
| 1393522 | 2/1965 | France | 24/67.7 |
| 156195 | 7/1932 | Switzerland . | |

*Primary Examiner*—James R. Brittain

*Attorney, Agent, or Firm*—Jon Paul Busack

[57] ABSTRACT

A piercing clamp for sheets of paper and the like, it includes a piercing jaw containing a piercing pin, and a holding jaw, and is urged closed by a spring. It is self piercing. Once a sheet of paper is pierced within the clamp, it retains its position relative to the clamp whether the clamp is open or closed. A guard may also be included to guard the piercing pin. The piercing clamp has great utility in a hanging clipboard. By piercing divider sheets within the clamp, other sheets may be inserted between the dividers without being pierced, allowing the piercing clamp to be used as a flier.

18 Claims, 3 Drawing Sheets

PIERCING CLAMP

FIELD of the INVENTION

The invention relates to paper retainment means such as clamps, clipboards and the like, particularly hanging clips and clipboards.

STATE of the RELATED ART

Paper retainment devices (such as clamps, clipboards and the like) fall into three general categories: those that grip, those that crimp, and those that pierce.

In gripping and crimping, jaws are typically urged together by a spring or held by a latch, and the paper so held is not intended to be permanently altered.

U.S. Pat. No. 4,628,572, "Clip Structure", issued to Chang, Oct. 10th, 1984, herein incorporated by reference, shows a good example of a gripping clipboard in FIGS. 1*a* and 1*b*. Further, Chang shows crimping in FIGS. 7-10, where the edge of body 102 mates with ridges 16.

Confederation Suisse Patent 156,195, issued Oct. 1st, 1932, herein incorporated by reference, appears to disclose a spring clamp gripping with points. As shown in FIGS. 7-9, points 19 on jaw 17 are pressed against jaw 18, with what appears to be paper held between.

U.S. Pat. No. Des. 288,901, "Spring Clip", issued Mar. 24th, 1987 to Zamek, herein incorporated by reference, utilizes crimping by bumps in one jaw mating with holes in the opposing jaw.

It is easily seen in the above that when new pages are added to a vertically disposed clamp, previously held pages want to fall out.

Exemplary piercing fasteners are now disclosed:

- U.S. Pat. No. 4,525,899, "Paper Fastener", issued Jul. 2nd, 1985 to Carroll, herein incorporated by reference;
- U.S. Pat. No. 4,241,477, "Paper Clip", issued Dec. 30th, 1980 to Freedom et al. ("Freedom"), herein incorporated by reference;
- U.S. Pat. No. 2,097,018, "Multiple Purpose Guide and Retention Clip", issued Oct. 26th, 1927 to Chamberlin, herein incorporated by reference;
- U.S. Pat. No. 1,976,747, "Thumb Tack", issued Oct. 16th, 1934 to Reuter et al. ("Reuter"), herein incorporated by reference;
- U.S. Pat. No. 1,054,498, "Paper Clip or Fastener", issued Feb. 25th, 1913 to Bleakney, herein incorporated by reference; and
- U.S. Pat. No. 457,783, "Marking Tag", issued Aug. 18th, 1891 to Kohnle, herein incorporated by reference.

Retainment in Carroll is primarily by piercing the paper and wedging it between prong 18 and the walls of slot 20, as shown in FIG. 3 and column 3 lines 32-36, for example. Carroll must be activated by finger pressure (column 3 lines 23-30) and when vertical and a new sheet is added, previously held sheets tend to fall out due to the frictional relationship of prong 18, slot 20 (for example), and the paper pressed between them: the paper is slid off the prong by its frictional relationship with the slot walls. Carroll's living hinge limits Carroll's life, due to plastic fatigue. Further, not many sheets can be held by Carroll.

Freedom is normally open and must be locked closed by finger pressure. When Freedom is opened, the pin is withdrawn from all sheets of paper, leaving them wanting to slip out. When the pin is again locked in the closed position, underlying sheets are re-pierced, leading to undue mutilation of the paper.

Chamberlin also requires finger pressure and bending of spurs 11. Chamberlin is not practically usable in a clipboard. Physical deformation due to folding at 7 and at spurs 11 forbids repeated use of Chamberlin.

Reuter is a thumbtack with a folding body and no spring. It is not practically usable in a clipboard. Physical deformation due to folding forbids extended use because of metal fatigue. Reuter requires finger pressure.

Bleakney is a piercing paper clip with a folding body and no spring, and shares the disadvantages of Reuter.

Kohnle is a marking tag with a folding body, no spring, and a deforming pin, requiring pressure, intended for tagging textiles and the like.

The state of the related art is clearly seen. When retaining devices such as described above are included in a hanging application, these problems exist:

1. When more pages are added, the pages previously retained want to fall out: the clamp cannot hold the pages when the jaws are open.
2. Those devices which pierce are not self piercing.

BRIEF DESCRIPTION of the DRAWINGS

In FIG. 1B, portions of the clamp are broken away for clarity. FIG. 1C demonstrates how sheets of paper are still retained even when the clamp is open, and also shows how a sheet of paper can be retained without piercing. FIG. 1D shows how the inventive clamp may be used for filing.

FIGS. 3B and 4B have portions broken away for clarity.

SUMMARY of the INVENTION

The inventive piercing clamp includes gripping jaws which are urged closed by a spring or the like. The piercing jaw has within it piercing pins with points facing toward the opposing holding jaw. When the holding jaw is made to mate with the pins, piercing and retainment of paper is enhanced.

In use, the clamp is opened, a sheet of paper is inserted, and the clamp is released. As the clamp is urged closed by the spring, the paper is automatically pierced and held, so being self piercing. When a new sheet is inserted, the clamp is again opened, but the original sheet does not want to slip out because it is still retained by the pins. When the clamp is released, the new sheet is automatically pierced and the original sheet is not repierced or otherwise mutilated. When a page is to be removed, it is a simple matter to open the clamp and lift the page out.

Paper and the like are thus securely held whether the clamp is opened or closed, yet are easily removeable and not unduly mutilated.

Further, each page, once pierced, stays in its own orientation relative to the clamp because the pins hold it there. Portions of several sheets can therefore be simultaneously displayed in a hanging clipboard. The pins allow each page to retain its original position when the clamp is opened to insert new pages.

The inventive clamp may also be used like a conventional clamp by inserting the paper up to but not past the piercing pins. Because of this, the clamp is therefore able to hold papers by its unique piercing and gripping action, while simultaneously clamping other papers conventionally. Of course, when used in this manner, the non-pierced papers will want to fall out conventionally as well.

DETAILED DESCRIPTION of the PREFERRED EMBODIMENTS

Figure 1A:
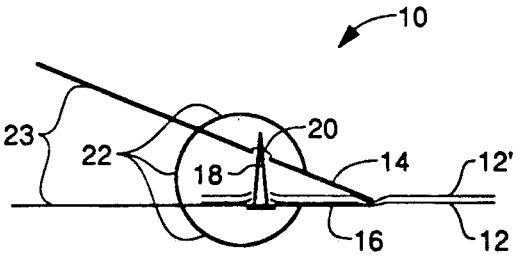
FIGS. 1A-1D show different views of the inventive piercing clamp. Sheets of paper in different orientations are demonstrated.

FIG. 1A shows a side view of piercing clamp 10 holding sheets of paper 12 and 12'. Clamp 10 includes holding jaw 14 and piercing jaw 16. Piercing pin 18 is attached within piercing jaw 16 and mates with hole 20 in holding jaw 14. Jaws 14 and 16 are urged together by means such as spring 22 and are urged apart by a user's pressure on handles 23.

A prototype was constructed by soldering a nail to one jaw of a conventional "bulldog" paper clamp and drilling a mating hole in the opposing jaw.

Figure 1B:
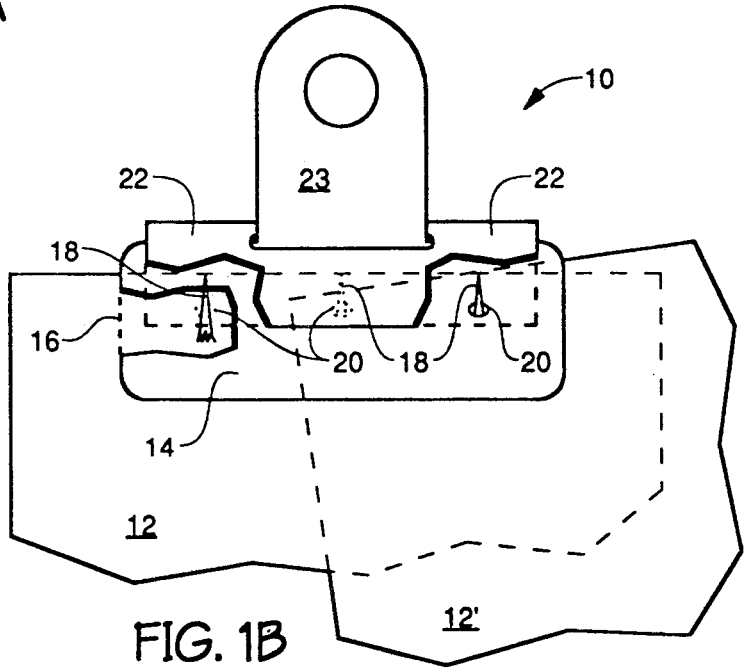
Figure 1C:
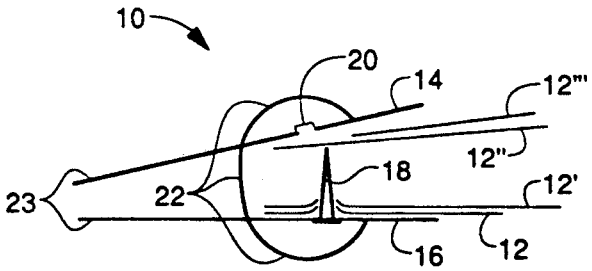

FIG. 1B demonstrates how sheets 12 and 12' each retain their own positions, and as shown by FIG. 1C, these positions are retained when clamp 10 is open. Also shown in FIG. 1C is new sheet 12'' being added. It is easily seen that sheet 12'' will be automatically pierced when clamp 10 closes, making the clamp self-piercing. New sheet 12''' is inserted partially so as not to be pierced. Spring 22 in this embodiment serves to urge jaws 14 and 16 closed and to act as a guard for piercing pins 18.

Figure 1D:
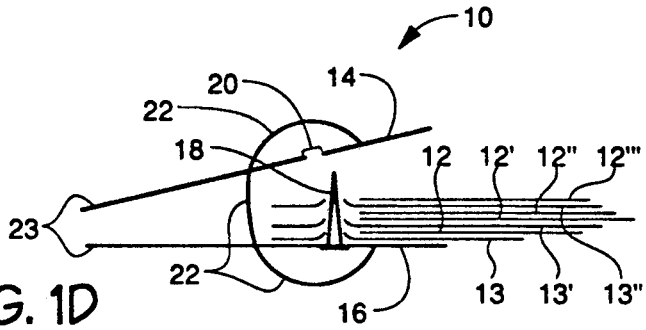

Because the inventive clamp can hold some pages by piercing and others by clamping, it can be used as a filer, as illustrated in FIG. 1D. Dividers 13, 13', and 13'' are pierced and retained as already described. Pages 12, 12', 12'', and 12''' are filed without piercing. Refiling is a simple matter of opening jaws 14 and 16 and sliding papers such as 12—12''' in and out.

Figure 2:
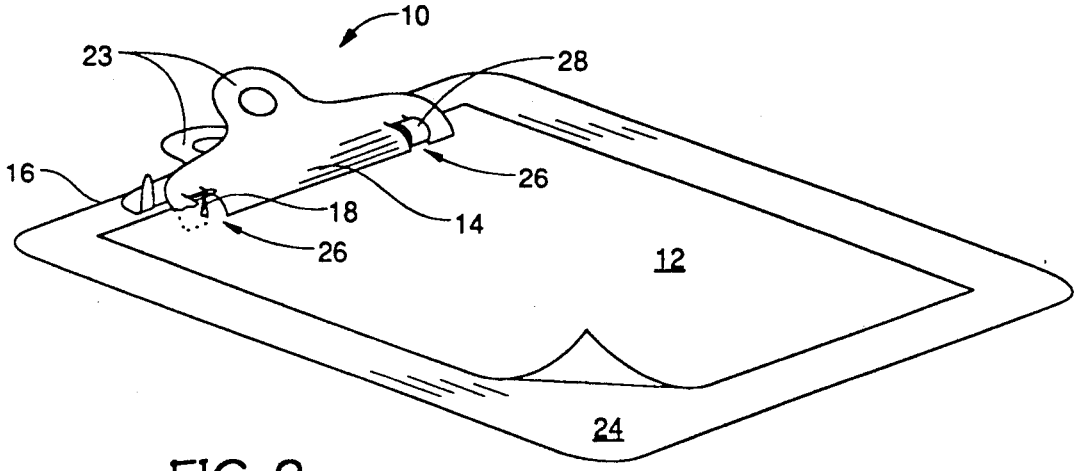
FIG. 2 illustrates a clipboard utilizing the inventive concepts. A portion of the clamp is broken away for clarity.

FIG. 2 shows the invention embodied in a clipboard. In this embodiment, board 24 acts as a piercing jaw for the piercing clamp 10. Also in this embodiment, portions of holding jaw 14 are stamped and bent to form mating regions 26 and guards 28. This clipboard performs like the clamp of FIG. 1. Alternatively, any of the piercing clamps disclosed herein may be attached to a board or the like, so making a clipboard.

Figure 3A:
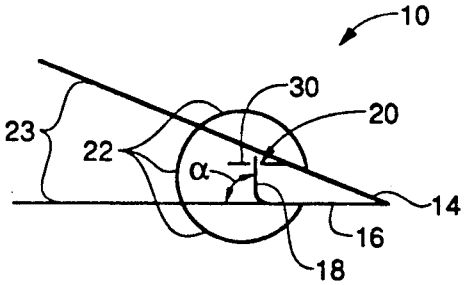
FIGS. 3A, 3B, 4A, and 4B show views of clamps where a piercing pin and hole are stamped and formed from the clamp material.
Figure 3B:
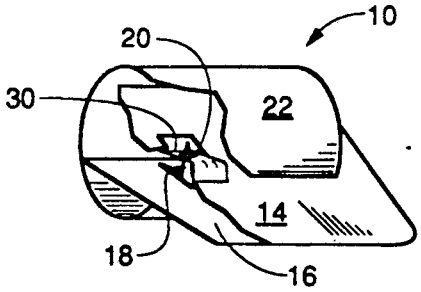

FIG. 3 illustrates a piercing clamp where piercing pin 18 is integrally formed out of the clamp material by stamping and forming or equivalent process. Piercing pin 18 is stamped and bent in from piercing jaw 16, and mating hole 20 is contained by a flap 30 stamped and bent in from holding jaw 14. In this embodiment, a guard is not required because piercing pin 18 does not protrude past holding jaw 14. During addition of a sheet of paper, flap 30 presses the sheet against piercing pin 18 during closure, so piercing it.

The embodiment of FIG. 3 has an additional advantage in that angle alpha may easily be made less than 90 degrees, enhancing paper retainment when the clamp is open.

Figure 4A:
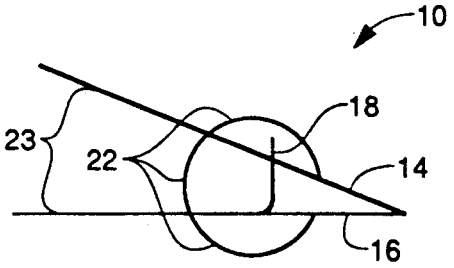
Figure 4B:
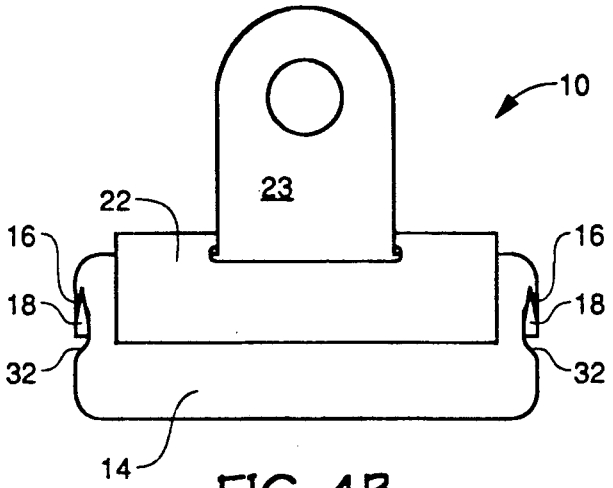

FIG. 4 shows another way that piercing pin 18 can be formed integrally from the edge of piercing jaw 16, mating with cutout portion 32 in the edge of holding jaw 14. Spring 22 acts as a guard although piercing pins 18 are not completely shielded by it.

Figure 5A:
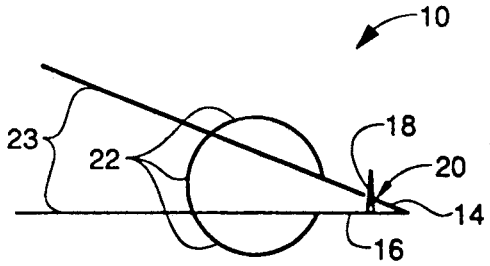
FIGS. 5A and 5B show a clamp with no guard.
Figure 5B:
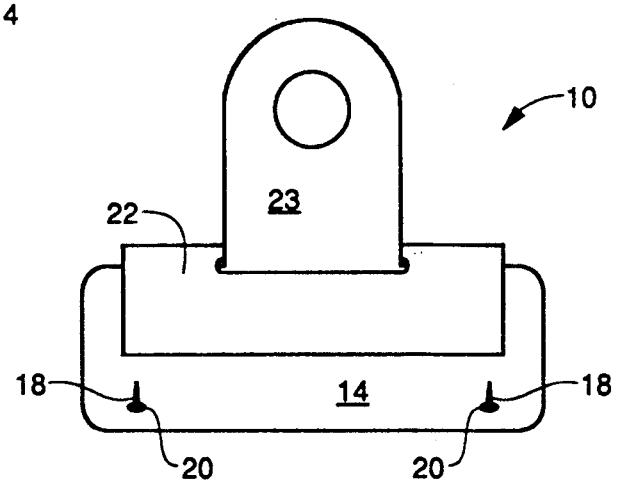

FIG. 5 illustrates jaws 14 and 16, piercing pins 18 with mating holes 20, and spring 22, no guard being provided for piercing pins 18.

Clearly, variations in embodiments may be made without stepping outside of the scope of the invention. Means, methods, and materials of formation of such clamps are well known and widely varied. Many kinds of springs are known, and may or may not be integrally formed with the clamp. I wish it to be understood that any of the embodiments disclosed apply equally to clamps and clipboards, hanging or otherwise, although the invention has high utility in hanging clips and clipboards. The inventive clamp also has utility in holding a workpiece not simply for hanging but for working, such as in the cutting of cloth. The inventive clamp has utility with paper and other piercable workpieces such as plastic, rubber, foil, and the like.

I claim:

1. A piercing clamp to retain a piercable workpiece, comprising:

a piercing jaw;

a piercing pin within said piercing jaw;

a holding jaw opposing said piercing jaw, configured with said piercing pin to be self piercing;

spring means, to urge said jaws closed and to urge self piercing;

whereby when the piercing clamp is closed, a piercable workpiece held therein is retained by said piercing pin and said jaws, and when the piercing clamp is open, the piercable workpiece is retained by said piercing pin, so that a piercable workpiece may be added to the piercing clamp without the previously retained workpiece losing its orientation within the piercing clamp;

wherein said spring means also guards said piercing pin by means of a portion thereof being positioned over said piercing pin when said jaws are closed.

2. A piercing clamp as recited in claim 1, wherein one of said jaws includes a board.

3. A piercing clamp as recited in claim 1, wherein said piercing pin has an angle alpha of 90° or less.

4. A piercing clamp as recited in claim 3, wherein said piercing pin is stamped from and bent within said piercing jaw.

5. A piercing clamp as recited in claim 1, further comprising a plurality of piercing pins, each within said piercing jaw.

6. A piercing clamp as recited in claim 1, further comprising a hole in said holding jaw, wherein self piercing is aided by said piercing pin mating with said hole.

7. A piercing clamp as recited in claim 1, further comprising means to assist a user in urging said jaws open.

8. A piercing clamp as recited in claim 1, wherein said piercing pin is within said piercing jaw far enough to allow an other piercable workpiece to be inserted into said jaws up to said piercing pin, on a side of said pin opposite from said spring means, so that the other piercable workpiece is not pierced yet retained by said jaws, and so that the piercing clamp may be used as a filer.

9. A piercing clamp as recited in claim 1, wherein said spring means comprises a split tubular spring.

10. A piercing clamp, to retain a piercable workpiece, comprising:

a piercing jaw;

a piercing pin within said piercing jaw;

a holding jaw opposing said piercing jaw, containing a hole that mates with said piercing pin when the piercing clamp is closed;

spring means, to urge said jaws closed, to urge self piercing, and to guard said piercing pin by means of a portion thereof being positioned over said piercing pin when said jaws are closed;

whereby when the piercing clamp is closed, a piercable workpiece held therein is retained by said piercing pin and said jaws, and when the piercing clamp is open, the piercable workpiece is retained by said piercing pin, so that a piercable workpiece may be added to the piercing clamp without the previously retained workpiece losing its orientation within the piercing clamp.

11. A piercing clamp as recited in claim 10, further comprising means to assist a user in urging said jaws open.

12. A piercing clamp as recited in claim 10, wherein one of said jaws includes a board.

13. A piercing clamp as recited in claim 10, wherein said piercing pin is within said piercing jaw far enough to allow an other piercable workpiece to be inserted into said jaws up to said piercing pin, on a side of said pin opposite from said spring means, so that the other piercable workpiece is not pierced yet retained by said jaws, and so that the piercing clamp may be used as a filer.

14. A piercing clamp as recited in claim 10, wherein said spring means comprises a split tubular spring.

15. A piercing clamp, to retain a piercable workpiece, comprising:

a piercing jaw;

a plurality of piercing pins within said piercing jaw;

a holding jaw opposing said piercing jaw, containing holes that mate with said piercing pins when the piercing clamp is closed;

spring means, to urge said jaws closed, to urge self piercing, and to guard said piercing pin by means of a portion thereof being positioned over said piercing pin when said jaws are closed;

handles attached to said jaws, to assist a user in urging said jaws open;

whereby when the piercing clamp is closed, a piercable workpiece held therein is retained by said piercing pins and said jaws, and when the piercing clamp is open, the piercable workpiece is retained by said piercing pins, so that a piercable workpiece may be added to the piercing clamp without the previously retained workpiece losing its orientation within the piercing clamp.

16. A piercing clamp as recited in claim 15, wherein one of said jaws includes a board.

17. A piercing clamp as recited in claim 15, wherein said piercing pins are within said piercing jaw far enough to allow an other piercable workpiece to be inserted into said jaws up to said piercing pins, on a side of said pins opposite from said spring means, so that the other piercable workpiece is not pierced yet retained by said jaws, and so that the piercing clamp may be used as a filer.

18. A piercing clamp as recited in claim 15, wherein said spring means comprises a split tubular spring.

* * * * *